United States Patent [19]

May et al.

[11] Patent Number: 4,480,704

[45] Date of Patent: Nov. 6, 1984

[54] REAMER

[75] Inventors: James R. May, Spring; Billy E. Black, Houston, both of Tex.

[73] Assignee: Smith International, Inc., Newport Beach, Calif.

[21] Appl. No.: 399,414

[22] Filed: Jul. 19, 1982

[51] Int. Cl.[3] ..... E21B 10/30

[52] U.S. Cl. ..... 175/228; 175/371; 175/347; 175/346

[58] Field of Search ..... 175/228, 344, 345, 346, 175/347, 348, 349, 371, 372; 277/12

[56] References Cited

U.S. PATENT DOCUMENTS 1,565,788 12/1925 Carlson ..... 175/346
2,809,015 10/1957 Phipps ..... 175/346
3,897,837 8/1975 Peterson ..... 175/347
4,182,425 1/1980 Garrett ..... 175/228

*Primary Examiner*—William F. Pate, III
*Assistant Examiner*—Timothy David Hovis

[57] ABSTRACT

A reamer used in earth boring by the rotary method includes a body having a plurality of sockets in its outer periphery. Upper and lower blocks are disposed in the socket for supporting a shaft. A roller is rotatably mounted on the shaft with the inner periphery of the roller and the outer periphery of the shaft providing bearings for the roller. The shaft has an upper annular shoulder with a downwardly facing sealing surface disposed above the bearings. Upper and lower seals are disposed above and below the bearings with the upper seals having a facing seal sealingly engaging the roller and the downwardly facing sealing surface on the shoulder of the shaft.

21 Claims, 4 Drawing Figures

REAMER

BACKGROUND OF THE INVENTION

This invention relates to earth boring and more particularly to roller reamers useful in the drill strings employed in the rotary system of drilling, either immediately above the drill bit or higher up in the string, i.e., between drill collars, for maintaining the hole at full gage.

Conventional roller reamers employ a plurality of rollers rotatably mounted at the periphery of the reamer body. The reamer body is provided at its ends with threaded connectors for connection at its top to a pipe string which extends back to the drill rig and at its bottom to a drill bit. A discussion of prior art roller reamers, field replaceable rollers, the lubrication of rollers, and mining tools is discussed in U.S. Pat. No. 4,182,425 and is incorporated herein by reference. Summarizing a portion of that discussion, the roller reamers may employ smooth rollers, hard faced rollers, or rollers with milled teeth. In overall operation the rotation of the reamer causes the cutters to rotate and to enlarge the borehole produced by the drill bit.

The rollers for reamers are often mounted to rotate on a shaft with the shaft mounted at the periphery of the reamer body. See U.S. Pat. Nos. 2,026,323; 2,189,031; 2,190,350; 2,199,693; 2,218,743; 2,272,405; 3,897,837; 4,013,325; 4,020,910; 4,182,425; 4,226,291; and 4,262,759. Other reamers, such as are disclosed in U.S. Pat. Nos. 4,102,416 and 4,227,586, include bearing journals extending from each end of the roller for providing rotation with respect to the reamer body.

The rollers and shafts are generally mounted at the periphery of the reamer body by blocks received in sockets formed in the body of the reamer such as shown in U.S. Pat. Nos. 2,026,323; 2,189,031; 2,190,350; 2,199,693; 2,218,743; 4,102,416; 4,182,425; 4,227,586; and 4,262,759. Generally, the blocks have bores for receiving the ends of the shaft. Such is shown in U.S. Pat. Nos. 2,026,323; 2,189,031; 2,190,350; 2,199,693; 2,218,743; 2,272,405; 4,182,425; and 4,227,586.

The ends of the shaft are secured to the block of the reamer body by various means. U.S. Pat. Nos. 2,026,323 and 4,182,425 disclose welding the upper end of the shaft to the block. U.S. Pat. No. 2,189,031 discloses threading the ends of the shaft into the blocks. U.S. Pat. Nos. 2,190,350; 2,199,693; 2,218,743; 2,272,405; and 3,897,837 teach holding the shaft in the block through the use of a key or pin. U.S. Pat. Nos. 2,189,031 and 2,218,743 show the use of screws to hold the shaft within the block.

Roller radial bearings and thrust washers have been used between the roller and shaft to facilitate the rotation of the roller thereon. Such bearings are shown in U.S. Pat. Nos. 2,026,323; 2,190,350; 2,199,693; 2,218,743; 2,272,405; 4,020,910; and 4,182,425. Other patents show the use of shaft bushings. U.S. Pat. No. 2,218,743 illustrates a shaft bushing welded to the block. U.S. Pat. Nos. 2,190,350 and 2,199,693 illustrate a bushing welded to the cutter. U.S. Pat. Nos. 2,218,743; 2,272,405; and 4,020,910 disclose shaft bushings with downwardly facing shoulders opposing the upper end of the rollers for the taking of thrust. U.S. Pat. No. 3,897,837 discloses thrust bearings between a shoulder on the shaft and the end of the rollers. U.S. Pat. Nos. 2,026,323; 2,190,350; and 2,199,693 show a bearing race disposed in part in the shaft.

Radially projecting shoulders have been utilized on the shaft and are disclosed in U.S. Pat. Nos. 2,026,323; 2,189,031; 3,897,837; and 4,102,416. In U.S. Pat. Nos. 2,189,031; 3,897,837; and 4,102,416 the shoulder of the shaft extends up inside the block. In U.S. Pat. No. 2,189,031 there appears to be an annular space between the block, shaft shoulder, and the end of the roller.

The space between each roller and shaft may be lubricated by various means. For example, such lubrication may be accomplished by the drilling fluid such as by air, water, mud, and oil passing through the body and back up the earth bore outside the reamer body. Reference may be made to U.S. Pat. Nos. 2,026,323; 2,190,350; 2,189,031; 2,199,693; 2,218,743; 2,272,405; 4,102,416; and 4,226,291. Another means is grease disposed between the roller and shaft. Drill bits have been provided with sealed lubricated bearings which have greatly increased the life of bits. See U.S. Pat. No. 4,249,622. Further, sealed lubricated bearings have not only been used for drill bits but for roller reamers and stabilizers. See for example, U.S. Pat. Nos. 3,413,045, 3,897,837; 4,020,910; 4,013,325; 4,182,425; and 4,262,759. A sealant reservoir for the lubrication of bearings in roller reamers is disclosed in U.S. Pat. Nos. 3,897,837; 4,013,325; 4,182,425; and 4,227,586.

Various sealing means have been provided to seal around the lubricated bearings. U.S. Pat. Nos. 3,897,837; 4,020,910; and 4,262,759 disclose a seal between the roller and the upper end of the shaft. U.S. Pat. Nos. 3,897,837; 4,182,425; and 4,227,586 utilize a seal between the shaft and the block. U.S. Pat. Nos. 4,013,325; 4,020,910; and 4,262,759 disclose a seal between the shaft and cutter. U.S. Pat. Nos. 3,897,837; 4,013,325; 4,020,910; 4,182,425; and 4,262,759 disclose a seal between the roller and the lower end of the shaft.

O-ring seals may be used to seal between the shaft and block as in U.S. Pat. Nos. 3,897,837 and 4,227,586 and to seal between the shaft and roller as shown in U.S. Pat. Nos. 4,013,325; 4,020,910; and 4,262,759. The weld between the upper end of the shaft and the block in U.S. Pat. No. 4,182,425 provides for sealing therebetween.

Two types of seals, namely radial seals and facing seals, may be provided to control the lubricant flow, to prevent loss of lubricant, and to exclude solids and debris from reaching the bearings of the rollers. Radial seals which sealingly engage the inner diameter of the roller and the outer diameter of the shaft are shown in U.S. Pat. Nos. 3,897,837; 4,013,325; 4,020,910; and 4,262,759. The seals are housed in grooves in the roller in U.S. Pat. Nos. 4,020,910 and 4,262,759 and in the grooves in the shaft in U.S. Pat. Nos. 3,897,837 and 4,262,759. In U.S. Pat. No. 4,227,586, the roller is not rotatably mounted on a shaft but includes male bearing journals at each end of the roller. The bearing journals are rotatably received within cylindrical bearing surfaces within bearing blocks. Seals are provided in grooves in the blocks for sealing between the shaft and block. U.S. Pat. No. 4,020,910 discloses a carrier housed in a groove in the roller with the carrier including both a radial seal, sealing between the carrier and shaft, and a facing seal, sealing between the carrier and a retainer on the roller.

A principal disadvantage of radial seals between the shaft and roller is that gravity causes the detritus to work down between the radial seal, shaft and roller to erode and deteriorate the radial seal.

U.S. Pat. No. 4,182,425 in FIG. 9 discloses a triple pressure balanced O-ring sealing at three places, i.e., around the shaft, around the flat top surface of the roller, and around the flat surface at the bottom of the groove in the block. Thus, the seal seals in the axial direction and radially inwardly. The seal in FIG. 9 is a rotating seal with the upper end of the shaft welded to the block.

In prior art sealed bearing reamers where an upper facing seal sealingly engages a sealing surface in a recessed bore in the upper block, the amount of compression established on the o-ring is critical to the achievement of a satisfactory seal life. This compression is determined by the distance between the sealing surface in the bottom of the groove in the block and the sealing surface on the upper end of the roller. These two sealing surfaces must be accurately positioned to achieve the desired compression on the o-ring which is disposed therebetween. Since the bearing race establishes the position of the roller with respect to the shaft, the distance from the bearing race to the upper seal face on the roller and the distance from the bearing race to the bottom of the groove in the block is critical. Where the upper end of the shaft is welded to the block, thereby positioning the sealing face on the block with respect to the sealing face on the roller, the specified distance for achieving the critical compression of the o-ring has been difficult to achieve in a production environment. It has proven difficult to position the shaft within the block and at the same time weld the shaft to the block to achieve the desired distance and therefore the desired compression of the o-ring.

Further, prior art designs require that the annular region between the internal diameter of the block and the outer diameter of the shaft be sealed. This is often accomplished by a weld between the block and shaft. This requires a relatively high-quality pressure-type weld, and results in the upper block becoming an integral part of the roller assembly.

Where the shaft has a bearing area for the rotation of the roller thereon, the shaft is carburized. If the shaft is welded to the block, it is necessary to mask the welding area of the shaft because of the carburization. The shaft is masked by leaving an enlarged end where the shaft will be welded and then the enlarged end is removed prior to welding. By eliminating the need to weld the shaft to the block, these steps are no longer necessary and the weld recess on the shaft is eliminated.

Further, welding the shaft to the block hinders the reuse of the upper block.

It is an object of the present invention to provide a roller reamer with improved sealing means between the roller and shaft thereby enhancing the life of the bearings. The present invention eliminates the need for welding between the block and shaft to position the upper sealing surface or to provide a seal between the shaft and block, and yet still provides the more desirable facing seals. Thus, the present invention provides an improved sealing means to control the lubricant flow, and to prevent loss of lubricant, and to exclude solids.

Other objects and advantages of the invention will appear hereinafter.

BRIEF DESCRIPTION OF THE DRAWINGS

For a detailed description of the preferred embodiment of the invention, reference will now be made to the following drawings wherein.

DESCRIPTION OF THE PREFERRED EMBODIMENT

Figure 1:
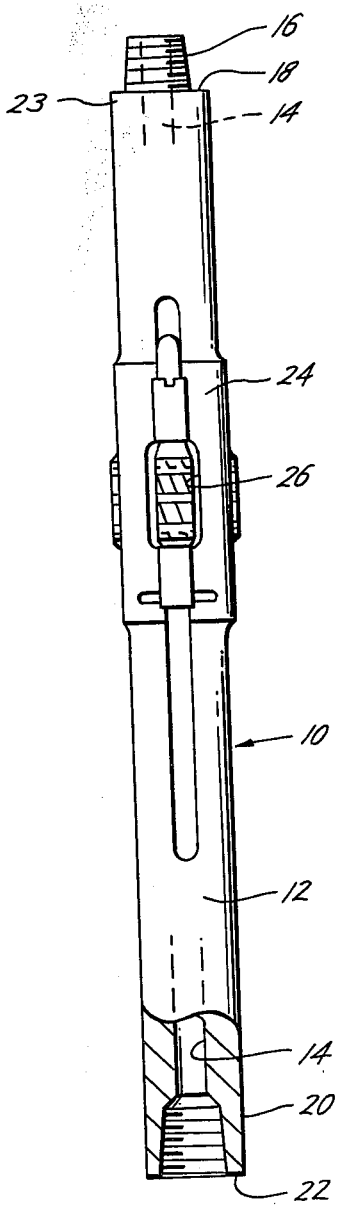
FIG. 1 is an elevational view of a typical reamer embodying the invention.

Referring initially to FIG. 1, there is shown a reamer 10 comprising a generally cylindrical tubular body 12 having a flow passage 14 extending axially therethrough. Means for making rotary shouldered connections with adjacent drill string members are provided at the upper and lower ends of the body 12, e.g. a tapered threaded pin 16 and shoulder 18 at the top and a correlative box 20 with shoulder 22 at the bottom. This arrangement is suitable for a reamer to be run between a drill collar and drill bit. If the reamer is to be used higher up in the drill string, the box would be at the top and the pin at the bottom, but the remainder of the reamer would be disposed as shown in FIG. 1. For a further disclosure of rotary shouldered connections see U.S. Pat. No. 3,754,609.

Figure 2:
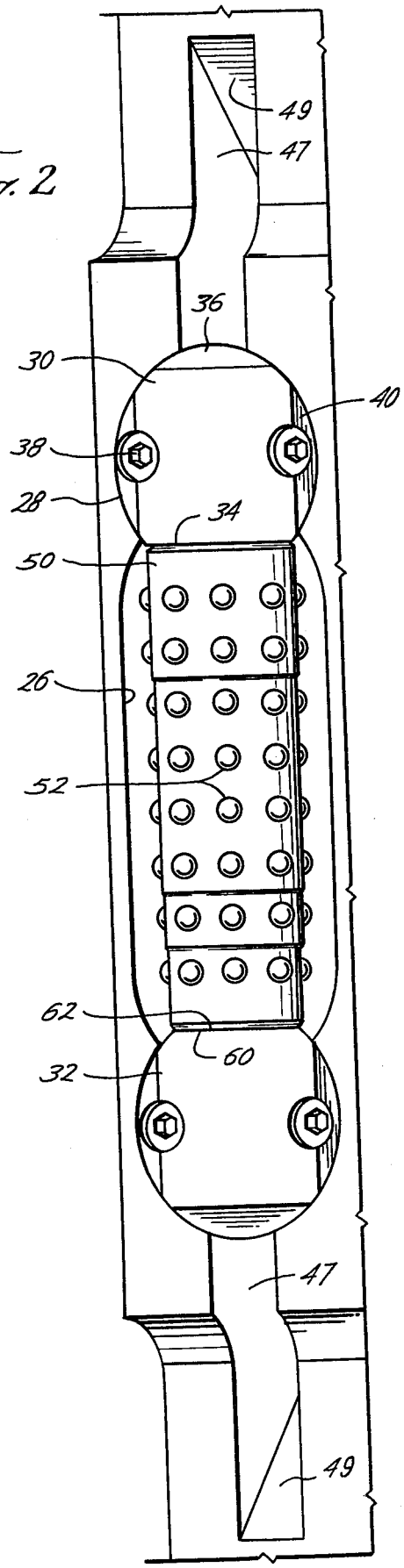
FIG. 2 is an enlarged fragmentary elevation view of a portion of the reamer of FIG. 1.

The midportion 24 of body 12 is of a larger diameter than the end portions. Carbide inserts may be used for body protection. As better shown in FIG. 2, within enlarged portion 24 is formed a plurality of elongated roller pockets 26. At the upper and lower ends of each roller pocket 26 are formed block sockets 28. Sockets 28 are generally cylindrical. Received within block sockets 28 are upper and lower blocks 30, 32, respectively. The blocks are generally cylindrical plugs but have flat side portions 34 adjacent pockets 26 and bevel 36 at their opposite sides. The blocks make a drive fit with the sockets 28. Two cap screws 38 hold each block 30, 32 to the body 12 after the block is driven into place. Threaded bores are provided in the body 12 to receive these screws, and the blocks are provided with unthreaded countersunk holes through which the screws 38 extend. The heads of the screws 38 are within the envelope of the outer surface of each block 30, 32, the outer surface being cylindrically curved concentric to the curvature of the midportion 24 of body 12. The outer surface of the blocks 30, 32 extends beyond the outer periphery of midportion 24 as provided with lateral bevels 40 merging with midportion 24. Bevels 36 and 40 guide the blocks over rough protuberant portions in the borehole as the reamer 10 rotates and is raised or lowered.

Figure 3:
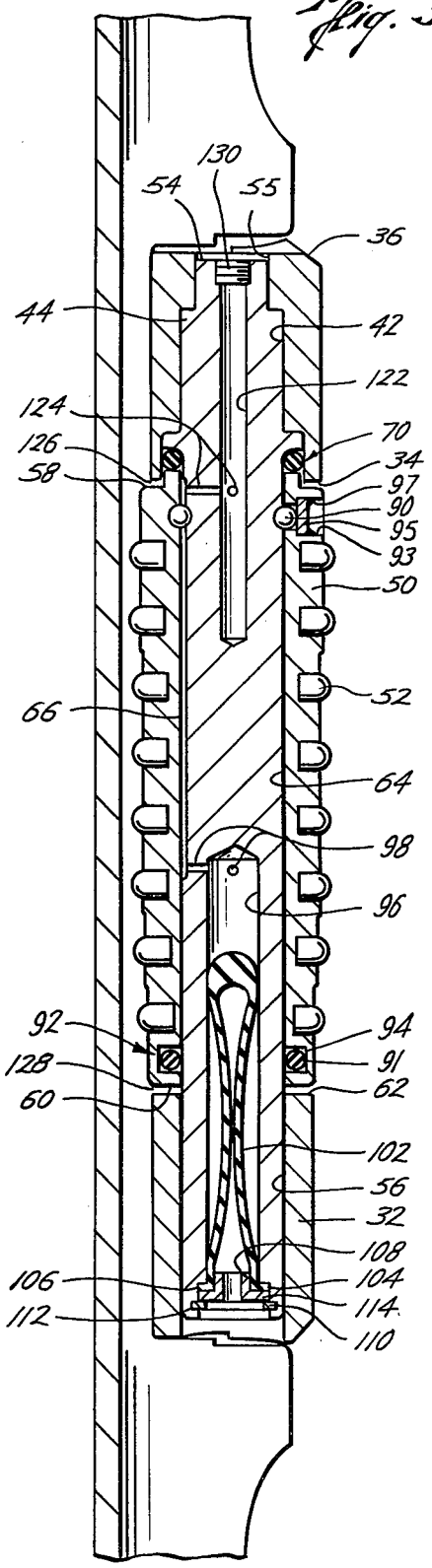
FIG. 3 is a sectional view of that portion of the reamer shown in FIG. 2.

Referring now to FIG. 3, blocks 30, 32 are provided with cylindrical bores 42 in which are received axles or shafts 44. Rollers or cutters 50 are rotatably mounted on shaft 44. Rollers 50 may be stepped and provided with rows of inserted tungsten carbide teeth 52. Other types of earth formation reducing means, e.g. mill teeth or "Q" cutters, may also be employed.

The drilling fluid inside the reamer flows through body passage 14 from the threaded box 20 to the threaded pin 16 without contacting the reamer rollers 50, which are located in pockets 26 on the exterior body 12.

Figure 4:
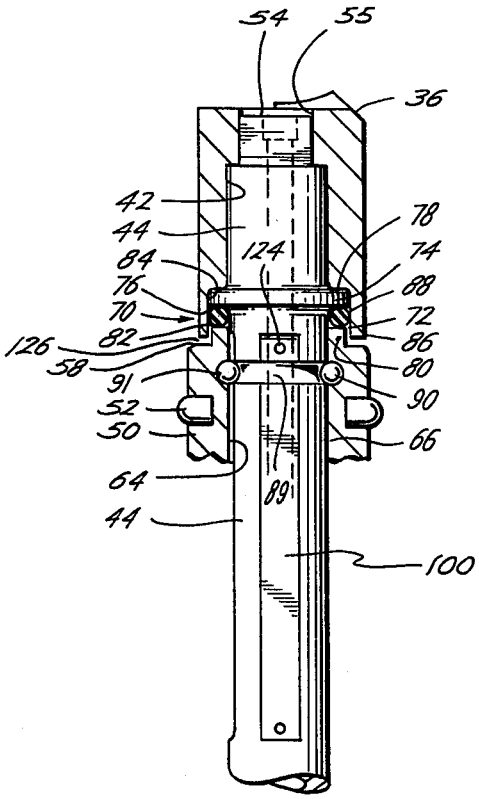
FIG. 4 is an enlarged sectional view of the seal means shown in FIG. 3.

Means are provided to prevent shaft 44 from rotating within blocks 30, 32. As shown in FIGS. 3 and 4, the upper terminus of shaft 44 is square in cross section at 54 and is received within a slot 55 in the upper portion of block 30. The flats on the square end of shaft 44 bear against the sides of slot 55 to prevent shaft 44 from rotating within block 30. There is no requirement for permanently attaching shaft 44 to block 30 to prevent rotation or to provide a seal therebetween. Alternatively, a roll pin may be passed through a hole in the upper end of shaft 44 and registered with a hole in the block 30. The roll pin could make an interference (drive) fit within the hole to hold it in place. Also, a pin, set screw, or other means may be used to prevent rotation.

All of the above-described means allow the removal and reuse of upper block 30. Because the borehole opens out, the upper block 30 does not wear as much as lower block 32 which is making hole. Thus, upper block 30 can be used two or three times. Although shaft 44 could be welded to block 30 to prevent rotation, this would prevent the reuse of upper block 30. Such a weld would not have to provide a seal between shaft 44 and block 30.

The lower end of each shaft 44 makes a close fit (snug or slight clearance) with the bore 56 in block 32. This provides firm support, but allows the blocks 30, 32 to rock about the axis of shaft 44, and to shift in the direction of the shaft axis, relative to each other, as may be necessary to fit into socket 28, but positively retains the shafts within the blocks.

Since the roller shafts 44 are mounted in holes 42 of blocks 30, 32 and blocks 30, 32 are set into sockets 28 in the reamer body 12, the body 12 can be made in one piece. In other words, the end portions of the body 12 where the connector means 16, 20 are located and the roller sockets 28 receiving the blocks 30, 32 can be made of one piece with the intermediate portion 24 of the body 12 containing roller pockets 26. There is no need to weld or otherwise integrate the end portions with the intermediate portion connecting same. The intermediate portion transmits torque, axial force, and bending moment between the end portions, reducing the strain on the shafts and blocks.

Axial load on roller 50 is taken by thrust bearings 90 disposed between shaft 44 and roller 50. Usually a roller tends to ream faster than the bit bores the hole so that roller 50 bears down against thrust bearings 90. However, in the event of upward force on roller 50, thrust bearings 90 will be sufficient to take such upward load. Thrust bearings 90 are disposed in a ball race formed by an annular groove 91 on the internal periphery of roller 50 and a corresponding annular groove 89 in the outer periphery of shaft 44. Grooves 89, 91 position roller 50 on shaft 44 and therefore determine the spacing between the two members. The bearing balls are inserted into race 91 through a radial port 93 in the side of roller 50. The port 93 is then closed by plug 95, seated against an annular shoulder in port 93 and held in place by a weld bead 97.

The upper and lower ends 58, 60 of roller 50 are flat to provide cooperating surfaces with the flat end surfaces 34, 62 respectively, on blocks 30, 32. The inner periphery 64 of roller 50 and the outer periphery 66 of shaft 44 serve as radial bearing surfaces as roller 50 rotates to maintain hole gage.

Provision is made for lubricating the roller and shaft bearing surfaces 64, 66 with grease. Each shaft 44 is provided with a reservoir, formed by an axial bore 96, which is filled with grease. A radial port 98 conveys the grease to a flat 100 milled on the periphery of shaft 44 and extends to radial port 124. The grease between roller 50 and shaft 44 lubricates the radial bearing surfaces 64, 66.

Each shaft is provided at its upper end with smaller diameter bore 122 communicating through radial port 124 with flat 100 between roller 50 and the upper part of shaft 44. By this means, reservoir 96 can be filled with grease by injection into passage 122. The end of passage 122 is releasably closed by threaded seal plug 130. Before filling the bore 122 with grease, it can first be evacuated by air by suitable means, not shown. A T-fitting can be used for first evacuating the air, then holding the vacuum, and then filling with grease.

A flexible diaphragm 102, which may be a tubular rubber sack, is disposed in one end of bore 96. The sack has at its mouth a rim 104 resting in annular space 106 and bore 96. Reinforcement tube 108, made of some rigid material, is disposed in the mouth of bore 96. A snap ring 110 is disposed in annular groove 112 in the end of space 106. Ring 110 bears against flange 114 on tube 108 to hold rim 104 of diaphragm 102 in recess 106. The central openings through snap ring 110 and tube 108 allow drilling fluid to contact the inside of diaphragm 102 for pressure equalization. If desired, a screen or other foraminous member may be placed in the center of flange 114 to filter the drilling fluid and keep detritus away from the diaphragm 102.

Continuing with reference to FIGS. 3 and 4, thrust bearings 90 and the grease for lubricating the roller and shaft bearing surfaces 64, 66 are sealed by means of upper facing seal means 70 and lower radial seal means 92. Seal means 70 and 92 are provided between shaft 44 and roller 50 to prevent the entry of sand-laden drilling mud between the radial load bearing surfaces of shaft 44 and roller 50, namely the cylindrical outer periphery 66 of shaft 44 and the cylindrical bore 64 of roller 50.

Referring initially to FIG. 4, upper facing seal means 70 is disposed in an annular cavity 72 formed by shaft 44, block 30, and roller 50. The upper end of shaft 44 includes a radially projecting annular flange 74 forming a downwardly facing annular sealing surface 76 and an upwardly facing annular stop shoulder 78. A radius has been provided on flange 74 to prevent stress risers. Should stress risers not be important, flange 74 may be square with shaft 44.

The upper end of roller 50 includes a reduced diameter portion or tongue 80 which forms an upwardly facing annular sealing surface 82. Upwardly facing annular sealing surface 82 is disposed opposite downwardly facing annular sealing surface 76 on flange 74.

Block 30 has a counterbore 84 coaxial with bore 42 receiving shaft 44. Counterbore 84 forms a skirt 86 extending towards roller 50 whereby counterbore 84 receives shaft flange 74 and a substantial portion of the reduced diameter portion 80 of roller 50. Stop shoulder 78 of flange 74 engages the bottom of counterbore 84 for limiting the insertion of flange 74 therewithin. Thus, cavity 72 if formed by downwardly facing annular sealing surface 76, the outer peripheral surface of shaft 44, upwardly facing sealing surface 82, and the internal periphery of skirt 86.

Upper facing seal means 70 includes an o-ring 88 disposed within cavity 72 whereby o-ring 88 sealingly engages sealing surfaces 76 and 82. 0-ring 88 is preferably made of nitrile rubber or other oil and water resistent elastomeric sealing material. Seal means 70 seals between shaft 44 and 50 to hold in the lubricant and prevent the entry of sand and other detritus.

A predetermined amount of axial compression between surfaces 76 and 82 on o-ring 88 is necessary to achieve a satisfactory life for seal means 70. Preferably, o-ring 88 should be compressed to approximately 12% to 19% of its thickness, i.e., cross-sectional diameter.

The sealing engagement of facing seal means 70 with annular flange 74 on shaft 44 rather than with block 30 provides several advantages. It eliminates the need for any seal between the block and shaft and particularly eliminates the necessity of a weld between the block and shaft for sealing therebetween. Seal means 70 permits a facing seal with shaft 44 rather than a radial seal which might permit detritus to pass between the radial seal, shaft, and roller. The shaft need not be permanently attached to the block. Further, accurate positioning of the shaft within the block is no longer required to obtain the desired seal compression. Also, the sealing surfaces are permitted to have a finer sealing surface. These advantages are discussed in more detail herein.

As indicated previously, grooves 89, 91, forming the bearing race for bearings 90, determines the positioning of roller 50 on shaft 44. To obtain the desired compression of o-ring 88 between sealing surfaces 76, 82, it is necessary that the vertical distance between surfaces 76, 82 be achieved with a great degree of accuracy. In the design of the present invention, the distance between the downwardly facing sealing surface 76 on shoulder 74 may be accurately located with respect to bearing race 90 by machining the upper sealing surface 76 and groove 89 at the same time. Further, the upwardly facing sealing surface 82 on the upper end of roller 50 may also be machined at the same time as groove 91 such that the distance between sealing surfaces 76 and 82 may be very accurately determined so as to provide the desired predetermined compression of o-ring 88 upon assembly. By machining the sealing surfaces and ball race grooves simultaneously, present day machine tools can very accurately and economically obtain an accurate vertical distance in cavity 72 whereby o-ring 88 may be compressed to approximately 12% to 19% of its thickness.

Downwardly facing sealing surface 76 may be lapped or ground to a 16 surface finish and upwardly facing sealing surface 82 may be lapped or ground to an 8 to 12 surface finish. The downwardly facing sealing surface 76 is somewhat rougher because of different processing. In the embodiment shown in FIGS. 3 and 4, there is a ⅛ inch contact path between the o-ring 88 and surfaces 76, 82.

The tolerance between groove 89 and surface 76 on flange 74 is plus or minus 0.001 inch. In the prior art where welding was required to attach and seal the shaft and block, the best tolerance that could be achieved was plus or minus 0.004 inch. Therefore, in the prior art the desired compression of the o-ring could not always be attained.

Seal means 70 provides a facing seal overcoming the principal disadvantage of radial seals where gravity causes the detritus to work down between the radial seal, shaft and roller to erode and deteriorate the radial seal. Facing seal means 70 is disposed above the space at 126 where sand and other detritus could work between the block 30 and roller 50. Because a facing seal is used between the upper end of cutter 50 and shaft shoulder 74, the detritus must move upwardly against the force of gravity between skirt 86 and tongue 80 to reach o-ring 88. Further, there is a 0.001 inch clearance between the internal periphery of skirt 86 and the upwardly extending tongue 80 of roller 50. This clearance is kept to a minimum to prevent large particles from passing between skirt 86 and tongue 80. A minimum clearance, however, is required to permit rotation of tongue 80 within counterbore 84.

Where a facing seal was used in the prior art, the seal sealingly engaged the roller and block, thereby requiring a second seal between the block and shaft. By seal means 70 sealing roller 50 and shaft 44 directly, the seal between the block and shaft is eliminated. Further, in the prior art where the weld between the block and shaft was relied upon as a seal, that weld is now eliminated both as a seal and as a means of preventing rotation between the shaft and roller.

Upper facing seal means 70 is primarily an axial or facing seal which seals with downwardly facing sealing surface 76 and upwardly facing sealing surface 82. The radial sealing contacts of seal means 70 with the internal periphery of skirt 86 and the external periphery of shaft 44 are secondary seals. In the unassembled position there is a clearance on both the internal and external diameter of o-ring 88 with respect to skirt 86 and shaft 44. Upon mounting the roller assembly onto reamer body 12, o-ring seal 88 becomes compressed between surfaces 76, 82 so as to sealingly engage the adjacent surfaces of shaft 44 and block 30. During operation, o-ring 88 is stationary with shaft 44 and does not rotate with roller 50. Although facing seal means 70 will not normally rotate within cavity 72, functionally it does not matter whether o-ring 88 rotates or not.

Seal means 70 is designed to outlast the seals used in drilling bits by three to four times.

Referring now to FIG. 3, a radial seal means 92 is disposed in an inner annular groove 94 at the lower end of roller 50. Radial seal means 92 includes an o-ring 99 which seals against the internal diameter of roller groove 94 and the outer diameter of shaft 44. Radial seal means 92 seals at two places, i.e., around the outer periphery of shaft 44 and with the bottom of annular groove 94 at the lower end of roller 50. o-ring 99 is exposed to ambient drilling fluid pressure through clearance 128 and to like grease pressure between the bearing surfaces 64, 66 of roller 50 and shaft 44.

Likewise, the interior and exterior pressures across o-ring 88 must be balanced. Since there may be a substantial downhole pressure, it is necessary to have an identical pressure on the grease in reservoir 96 or otherwise o-ring 88 will tend to extrude. Since the grease reservoir 96 is at ambient drilling fluid pressure due to one wall of the reservoir being formed by pressure equalizing flexible diaphram 102, the internal pressures on the facing seal means 70 are the same as that on the exterior thereof since the facing seal is exposed to ambient drilling fluid pressure through clearance 126.

FIG. 3 illustrates diaphragm 102 in a partially collapsed condition. Such collapse occurs when grease is introduced into reservoir 96. Diaphragm 102 is in the relaxed condition just after the reamer roller assembly is assembled and prior to putting grease in the reservoir 96. The roller assembly is greased before it is installed into reamer body 10.

While a preferred embodiment of the invention has been shown and described, modifications thereof can be made by one skilled in the art without departing from the spirit of the invention.

We claim:

1. A wall-contacting apparatus useful in earth boring by the rotary method, comprising:

a body having at least one socket in its outer periphery;

upper and lower blocks disposed in said socket;

a shaft supported at each end by said upper and lower blocks;

a roller rotatably mounted on said shaft, said roller having a hole extending axially thereof through which extends said shaft, the inner periphery of said roller and the outer periphery of said shaft providing bearing means for said roller;

said shaft having a shoulder forming a downwardly facing first sealing surface disposed above said bearing means;

said roller having an upwardly facing second sealing surface opposite to said first sealing surface;

upper and lower sealing means disposed above and below said bearing means; and said upper sealing means including a sealing member, said first sealing surface compressing said sealing member against said second sealing surface forming a facing seal between said shaft and roller.

2. The apparatus of claim 1 wherein said shoulder is disposed on an annular flange radially projecting from said shaft.

3. The apparatus of claim 1 wherein said sealing member is elastomeric.

4. The apparatus of claim 3 wherein said elastomeric member is compressed between 12% and 19% of said member's vertical cross section.

5. The apparatus of claim 3 wherein said sealing member sealingly engages the outer periphery of said shaft and the inner periphery of a bore in said block, said bore receiving one end of said shaft.

6. The apparatus of claim 1 and including removable means for preventing rotation of said shaft with respect to said upper and lower blocks.

7. The apparatus of claim 6 wherein said means includes flats on said shaft bearing against the walls of said upper block.

8. The apparatus of claim 1 wherein said block includes a bore receiving one end of said shaft and a reduced diameter portion of said roller, the clearance between the mouth of said bore and the shoulder created by said reduced diameter portion being disposed below said sealing member.

9. The apparatus of claim 1 wherein said shaft, roller and block form a cavity within which is housed said sealing member.

10. The apparatus of claim 9 wherein said upper block includes a bore receiving one end of said shaft and a counterbore coaxial with said bore for receiving one end of said roller.

11. The apparatus of claim 10 wherein said shaft shoulder is received by said counterbore.

12. The apparatus of claim 12 wherein said one end of said roller includes said second sealing surface.

13. The apparatus of claim 12 wherein said second said sealing surface is disposed on a reduced diameter portion on said one end of said roller.

14. The apparatus of claim 9 or 12 wherein said sealing member includes an o-ring disposed in said cavity.

15. The apparatus of claim 9 and including means for equalizing the pressure across said o-ring.

16. The apparatus of claim 13 wherein said first and said second sealing surfaces are milled to at least a 16 surface finish.

17. The apparatus of claim 1 wherein said lower sealing means includes an o-ring housed in an annular groove in said roller and engaging the outer peripheral surface of said shaft.

18. A wall contacting apparatus useful in earth boring by the rotary method, comprising:

a body having first and second aligned end portions and a plurality of sockets on its outer periphery;

thread means at a terminus of each end portion for making a rotary shoulder connection with an adjacent drill string member;

a plurality of blocks disposed in each of said sockets and having side walls generally correlative to those of said sockets;

a plurality of shafts, each supported at each end by one of the blocks in different ones of said sockets;

a roller rotatably mounted on each shaft, each roller having a hole extending axially thereof, through which extends the shaft on which the roller is rotatably mounted, the inner periphery of said roller at said hole and the outer periphery of said shaft providing radial bearing means for the roller;

thrust bearing means for each roller to take the axial thrust thereon comprising shoulder means on each roller and cooperative shoulder means on replaceable support means for the roller;

said shoulder means on each replaceable support means comprising radially protuberant means extending from the shaft located in a position in between the ends of the rollers, and said shoulder means on each roller comprising an annular groove in the roller's inner periphery, within which groove is captured the radially protuberant means, thereby to take axial thrust on the roller in both directions and transfer it to the shaft;

said radially protuberant means comprising a plurality of balls disposed in an annular channel around the shaft, each said roller comprising a roller fabricated with a filler opening through which said balls can be introduced into the toroidal space formed by the shaft channel and cooperating roller groove when in register, and means closing said filler opening, means to seal between each roller and shaft on opposite sides of said radially protuberant means;

lubricant reservoir means in each shaft communicating with the exterior of the shaft between said sealing means; and said sealing means including an axially facing first sealing surface on each said shaft and an axially facing second sealing surface on each said roller opposite to said first sealing surface, said first sealing surface compressing a sealing member against said second sealing surface forming a facing seal between each said shaft and each said roller.

19. A well-contacting apparatus useful in earth boring by the rotary method comprising:

a body;

a block supported by said body and having a first radial sealing surface;

a shaft supported at one end by said block and having a first axially facing sealing surface and a second radial sealing surface opposite said first radial sealing surface;

a roller rotatably mounted on said shaft, said roller having a hole extending axially thereof through which extends said shaft and having a second axially facing sealing surface opposite said first axially facing sealing surface;

an elastomeric sealing member disposed between said first and second axially facing sealing surfaces and said first and second radial sealing surfaces; said elastomeric sealing member establishing a sealing engagement with said second radial sealing surface and said first axially facing sealing surface of said shaft, a sealing engagement with said first radial sealing surface of said block, and a sealing engagement with said second axially facing sealing surface of said roller.

20. The apparatus of claim 19 wherein said roller and shaft compress said elastomeric sealing member between said first and second axially facing sealing surfaces to form a facing seal between said shaft and said roller.

21. The apparatus of claim 20 further including means for accurately maintaining a predetermined compression of said elastomeric sealing member between said shaft and roller.

* * * * *

UNITED STATES PATENT AND TRADEMARK OFFICE

CERTIFICATE OF CORRECTION

PATENT NO. : 4,480,704

DATED : NOVEMBER 6, 1984

INVENTOR(S) : JAMES R. MAY, BILLY E. BLACK

It is certified that error appears in the above—identified patent and that said Letters Patent is hereby corrected as shown below:

Column 6, line 58; delete "if" and insert — is —.

Column 7, line 21; change "determines" to — determine —.

Claim 12, Column 9, line 55; delete "12" and insert — 11 —.

Claim 13, Column 9, line 58; delete "said".

Claim 16, Column 9, line 64; delete "13" and insert — 12 —.

Signed and Sealed this

*Thirtieth* Day of *July 1985*

[SEAL]

*Attest:*

DONALD J. QUIGG

*Attesting Officer* *Acting Commissioner of Patents and Trademarks*